US005289150A

United States Patent [19]

Rabinowitz

[11] Patent Number: 5,289,150

[45] Date of Patent: Feb. 22, 1994

[54] METHOD AND APPARATUS FOR SUPERCONDUCTING TRAPPED-FIELD ENERGY STORAGE AND POWER STABILIZATION

[75] Inventor: Mario Rabinowitz, Redwood City, Calif.

[73] Assignee: Electric Power Research Institute, Palo Alto, Calif.

[21] Appl. No.: 752,307

[22] Filed: Aug. 30, 1991

[51] Int. Cl.[5] ..... H01F 1/00

[52] U.S. Cl. ..... 335/216; 310/52

[58] Field of Search ..... 310/52; 335/216; 310/10, 40, 261, 264, 265

[56] References Cited

U.S. PATENT DOCUMENTS

| | | | |
|---|---|---|---|
| 4,000,036 | 12/1976 | Ensley | 315/111 |
| 4,176,291 | 11/1979 | Rabinowitz . | |
| 4,348,630 | 9/1982 | Boenig et al. | 323/207 |
| 5,011,823 | 4/1991 | Jin et al. | 505/733 |
| 5,110,793 | 5/1992 | De | 505/869 |

OTHER PUBLICATIONS

Garwin, et al., "Permanent multipole magnetic fields stored in superconductors", *Applied Physics Letters*, (Jun. 1973), vol. 22, No. 11; pp. 599–600.

Rabinowitz, et al., "An Investigation of the Very Incomplete Meissner Effect", *Lettere Al Nuovo Cimento*, (Mar. 1973), vol. 7, No. 1, pp. 1–4.

Rabinowitz, Mario, "Multipole Magnetic Field Trapping by Superconductors", *IEEE Transactions on Magnetics*, (Mar. '75) vol. MAG-11, No. 2, pp. 548–550.

Rabinowitz, et al, "Dependence of maximum trappable field on superconducting Nb3Sn cylinder wall thickness", *Applied Physics Letters*, (Jun. '77), vol. 30, No. 1, pp. 607–609.

Author Unknown, "Superconducting Magnetic Energy Storage (SMES) Engineering Test Model (ETM)", publication unknown, pp. 1–6.

*Primary Examiner*—Lincoln Donovan

*Attorney, Agent, or Firm*—Townsend and Townsend Khourie and Crew

[57] ABSTRACT

Magnetic energy is stored in trapped form in a wide variety of superconducting masses such as granules, particulates, foil, and thin film to be released as electrical energy by magnetically coupling to a normal coil as the trapped field is caused to decay. This trapped-field energy storage (TES) has many advantages over other superconducting energy storage schemes including elevated temperature operation, lowered refrigeration capital and operating costs, lowered costs of cryogen, lowered thermal conduction losses, lowered cost of thermal insulation, capability of operating in modular form, and transportability of the trapped magnetic energy.

24 Claims, 4 Drawing Sheets

METHOD AND APPARATUS FOR SUPERCONDUCTING TRAPPED-FIELD ENERGY STORAGE AND POWER STABILIZATION

FIELD OF THE INVENTION

This invention relates generally, but not exclusively, to superconducting trapped-field magnetic energy storage for electric power utility applications and enhanced electric power stability by the utilization of trapped field superconductivity in a variety of bulk, particulate, foil, and thin film superconducting materials that are not in the form of a cable or wire coil.

DEFINITIONS

"Energy storage" in the context of the invention refers primarily to electric power utility applications wherein energy is stored during off-peak times to be delivered back to the power system during high demand times when the load is high. However "energy storage" may also entail secondary applications, such as in the communications field, emergency power, as a power source for relatively small and compact purposes, and a myriad of other generically related applications.

"Trapped field" in the context of this invention refers to a trapped or stored magnetic field in a variety of forms, such as a bulk, particulate, foil, and thin film superconductor that has *not* been expressly manufactured as cable or wire to be used in loop or coil form. In my invention there is no intent to make a superconducting electromagnet similar to a normal electromagnet as in conventional "superconducting magnetic energy storage", herein referred to as SMES. In contradistinction, the superconducting "trapped-field energy storage" of the instant invention will herein more briefly be referred to as "TES".

"Power stability" in the context of this invention refers primarily to electric power utility applications in which unwanted and potentially destabilizing power oscillations in the power grid are damped by diverting their energy into the TES apparatus of this invention. The term "power stability" also includes system voltage regulation.

"Graetz bridge" is a normally thyristorized converter bridge which is widely used and accepted by the power industry. It converts or rectifies ac into dc; and also can invert dc and ac. "Graetz bridge" as used herein represents one of many possible interfaces beween the power system (normally three phase) and the unique TES superconducting energy storage system to be described in the specification of this invention.

"Persistent current" is a mode of operation of a superconducting wire in coil or loop form in which current is established in the wire by induction if the superconducting loop forms a closed circuit. An emf may also be used to establish the supercurrent, after which it is shorted out of the circuit with a superconducting switch. What remains is a superconducting current which "persists" in the superconducting loop without a voltage source. If the loop (circuit) is opened at any point, the current is disrupted and the magnetic field decays around the wire. This is in contrast to the vortex superconducting currents in TES. These vortex currents are microscopic currents around each fluxoid (quantized bundle of magnetic flux). The vector sum of these vortex currents is equivalent to a circulating transport current. If the trapped field superconductor is cut, there is only a local disruption of the magnetic field locally at the cut, and the overall magnetic field is maintained.

"Meissner Effect" is the expulsion of a magnetic field from the bulk of a superconductor in a transition from the normal to the superconducting state. However it is now well established in both the low temperature and high temperature superconductors that a virtual violation of the Meissner Effect can be made to occur so that large magnetic fields may remain trapped in the bulk of a superconductor after the original applied field is removed.

DESCRIPTION OF THE PRIOR ART

Conventional Superconducting Magnetic Energy Storage, SMES, has been studied for two decades starting with the pioneering work at the University of Wisconsin and the Los Alamos National Laboratory. Both the initial work and subsequent studies have focussed on storing the energy in the electromagnetic field of a current carrying superconducting coil located underground so that the earth can provide a low-cost support for the coil against magnetically induced forces. When the coil is energized, the magnetic field acts on the conductor to produce a strong radially outward force, and strong axially compressive force. As one mode of operation SMES may be operated in what is called the persistent current mode (cf. DEFINITIONS). This is not at all the same thing as trapped-field energy storage TES (cf. DEFINITIONS) in which the superconducting current is the vector sum of induced microscopic vortex currents.

Although TES appears to be antithetical to the Meissner Effect, it has been shown by M. Rabinowitz and his colleagues that any field configuration from low to high field strength can be trapped in both Type I and Type II superconductors. Rabinowitz and his colleagues trapped the largest field yet reported, 22,400 Oe, as described in the scientific journal Applied Physics Letters 30, 607 (1977) by M. Rabinowitz, H. Arrowsmith, and S. D. Dahlgren. Their work shows that even larger fields are possible. Fields almost as high have been trapped in high temperature superconductors at 77K, and much higher fields may be expected.

The fidelity of the trapped field to the original field has been shown to be quite high, and any field configuration may be trapped. For example, dipole, quadrupole, and sextupole magnetic fields have been trapped transversely to the axes of solid, hollow, and split-hollow superconducting cylinders. This work has been reported in IEEE Trans. on Magnetics, MAG 11, 548 (1975) by M. Rabinowitz; Nuovo Cimento Letters 7, 1 (1973) by M. Rabinowitz, E. L. Garwin, and D. J. Frankel; and Appl. Phys. Letters 22, 599 (1973) by E. L. Garwin, M. Rabinowitz, and D. J. Frankel. The Nuovo Cimento Letters paper explains how the field trapping is accomplished by means of a virtual violation of the Meissner effect.

A U.S. Pat. No. 4,176,291, Stored Field Superconducting Electrical Machine and Method, utilizing trapped magnetic fields for superconducting motors and generators was issued to Mario Rabinowitz in 1979. A trapped field superconducting motor has subsequently been built and operated at 77K using a high temperature superconductor.

BACKGROUND OF THE INVENTION

The value of energy storage systems to electric power utilities has increased as the cost of basic energy sources such as oil and gas has continued to escalate. These systems store energy during periods of excess power output in off-peak periods when the demand for electricity is low. They then supply electricity during peak load periods to augment normal turbine-generator power production.

To data SMES has been the only known method for the direct storage of energy as electricity, and as such is the most efficient method. The energy is stored in the magnetic field of a superconducting inductor carrying a dc supercurrent. Other devices convert the excess generated electricity into other forms of energy such as hydro-mechanical, compressed air, thermal, flywheel, chemical (batteries), etc. Such devices must then must reconvert the energy back for use as electricity, thus making such devices relatively inefficient.

Because of its rapid response time, SMES can also enhance electric power stability by damping unwanted power oscillations and by providing voltage regulation. Power oscillations can be caused by various factors such as a large separation of major load and generation centers, inductance-capacitance coupling in the power circuit, and turbine-generator shaft oscillations.

The round-trip ac-dc-ac efficiency of about 90% for SMES is limited primarily by refrigeration which is in turn related to cryogenic losses, such as heat leak and power losses in the superconductor. The dc current circulates with no power loss in the superconducting inductor. There is a power loss in the superconductor during conversion from ac to dc, and from dc to ac. Despite the high efficiency of SMES, it has a major drawback of high capital cost per kWh of stored energy. This requires a very large system to be competitive with other storage systems. Both the capital cost per unit energy stored, as well as the overall capital cost is high compared with other storage systems. SMES capital cost is approximately proportional to system size raised to the two-thirds power, giving an economy of scale. (This is like a surface-to-volume ratio in which the materials and related costs scale like a surface and the stored energy is proportional to a volume.) Thus if the system size is doubled, the cost per unit energy stored will be about 80% of the original cost. There is a limit to increasing the size beyond the ability of a utility to bear a huge financial burden which is over a billion dollars, as well as site limitation problems for a huge SMES facility.

A number of things contribute to the high capital cost of SMES. One is the high cost of making superconducting wire or cable and forming it into a coil. Over half of the costs of SMES are related to the conductor coil material (low temperature superconductor plus the stabilizing normal conductor, Al), its axial support structure, and fabrication cost. Presently only the low temperature metallic superconductors are applicable to SMES, as the high temperature oxide superconductors are greatly limited in both their current carrying capacity (low critical current density) and in their brittleness. In either case (low or high temperature superconductor), eliminating the need for superconducting wire or cable as in the present invention will reduce capital cost.

At present SMES is a very low temperature system limited to operation at liquid helium temperature (4.2K) and preferably superfluid helium temperature at 1.8K to effect a reduction in overall costs. An expensive closed cycle refrigerator maintains the most expensive cryogen, helium, at 1.8K. In order to reduce heat leak to the coil, the low temperature components operate inside a vacuum insulated cryogenic enclosure (dewar) that surrounds the helium vessel. This vessel must be completely tight making it quite expensive, as a single pinhole would cause disastrous loss of the superfluid helium. Superfluid helium not only has the largest known heat transfer capability for cooling the superconducting coil, but it also has no viscosity and would quickly drain out through a pinhole. An expensive vacuum pump-down system is used to evacuate the dewar which must be leakfree to air. Thermal radiation shields are present in the dewar to reduce heat leak from the 300K (ambient temperature) support structure (bedrock or just earth). A support structure is necessary as both the stored energy density and the pressure produced by the magnetic field of flux density B are proportional to $B^2$. For example for B=5 Tesla (50,000 Gauss), the stored energy density would be 10,000,000 Joules/$m^3$, and the pressure would be 100 atmospheres. For B=10 Tesla, the stored energy density would be 40,000,000 Joules/$m^3$, and the pressure would be 400 atmospheres.

OBJECTS OF THE INVENTION

The general objective of the present invention is to provide trapped-field superconducting magnetic energy storage apparatus and method without requiring the use of superconducting cable or wire.

One main object is to provide an apparatus which allows an increase in the operating temperature of magnetic energy storage.

Another object is to provide an apparatus which allows a decrease in the overall capital cost of magnetic energy storage.

More specific objects of this invention are to provide an apparatus and method which permit the realization of decreased refrigeration and cryogen costs; a decrease in the cost of the cryostat; modular sequential magnetic field trapping for energy storage; and modular energy release for a gradual input of power into the external circuit.

Another specific object of this invention is to decrease thermal insulation costs, and to eliminate the need for a vacuum system and vacuum pump-down equipment.

Another object of this invention is to provide apparatus and method which allow an increase in the heat capacity of the materials of the apparatus at cryogenic temperature.

Another specific object of this invention is to provide an apparatus which increases the thermal conductivity of the materials at cryogenic temperature.

Further objects, features, and manifestations of the invention will be more readily apparent from the detailed description in which several embodiments have been set forth in detail in conjunction with the accompanying drawings.

SUMMARY OF THE INVENTION

TES can accomplish energy storage and power stability much less expensively than SMES, and with almost as high an efficiency. The energy in destabilizing oscillations can be quickly diverted into the TES to enhance power system stability. Because of the wire problems previously discussed, it would not be possible to construct a practical SMES system for use with high temperature superconductor at elevated temperature e.g. 77K. However high temperature superconductor can be used in a variety of bulk, particulate, foil, and thin film form in this invention, not requiring wire or cable. Thus TES may gain the advantages of elevated temperature operation related to lowered refrigeration capital and operating costs, lowered costs of cryogen, lowered thermal conduction losses, lowered cost of thermal insulation, etc. Elevated temperature operation (relative to 4K) increases the heat capacity and the thermal conductivity of the materials at cryogenic temperature. This needs to be balanced with greater stability of the trapped magnetic field and less likelihood of unwanted flux flow, the lower the operating temperature is relative to the critical (transition) temperature, $T_c$, of the superconductor. All other things being equal, the higher $T_c$ superconductors are preferred for this reason.

TES may be coupled to the external power system by any of a number of ways such as a Graetz bridge, flux pump, homopolar generator, and the like. For convenience, the coupling (interface) between TES and the power system will herein be illustrated as a preferred embodiment by means of a Graetz bridge though other interfaces may well be used.

The incentive for the present invention is the ability of TES to appreciably reduce the capital costs of direct electrical energy storage and enhanced power stability compared with SMES. Even if this occurs with a slight increase in power losses compared with SMES, the TES system should still be more efficient than other storage systems. The point to bear in mind is that both the cost of losses and the cost of capital (interest on the invested money) are important considerations. TES is a very competitive energy storage system considering overall system cost, and the sum of cost of losses plus cost of capital. This will become evident as the present TES invention is described in detail with specific embodiments.

DETAILED DESCRIPTION OF THE PREFERRED EMBODIMENTS

Overview

Figure 1:
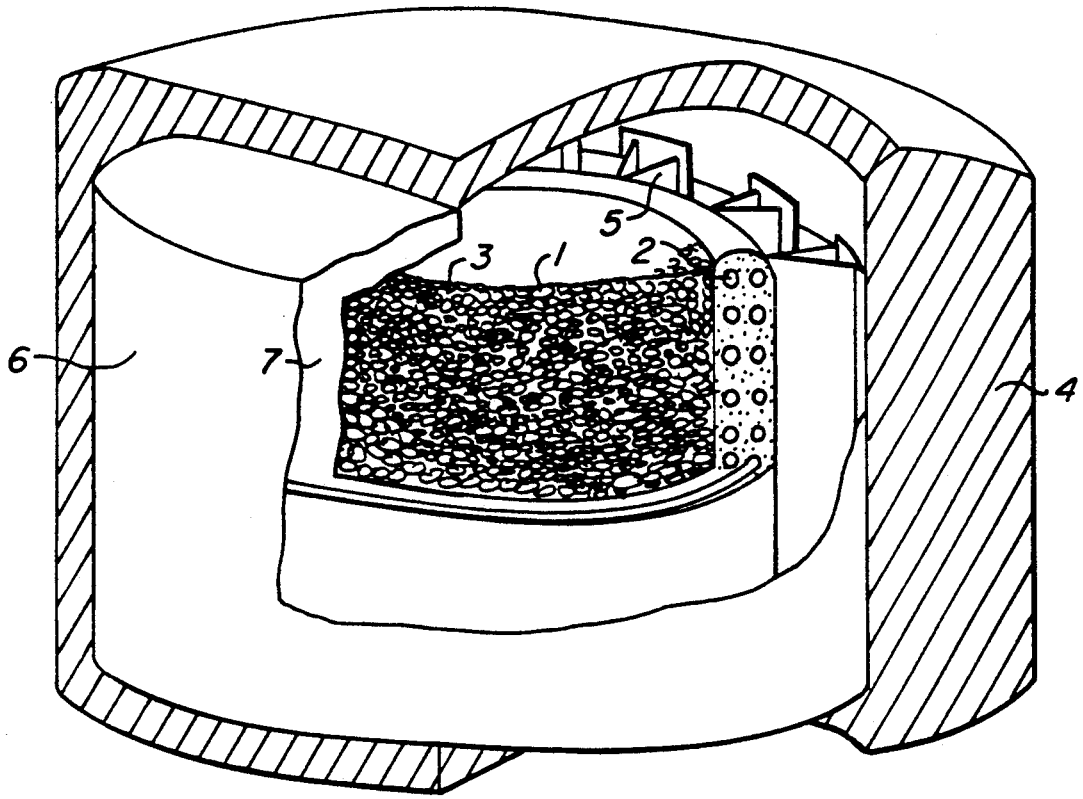
FIG. 1 is a schematic cut-away view of an underground TES system embodiment of the present invention.

The present invention incorporates method and apparatus for providing superconducting trapped magnetic field energy storage (TES) without the use of superconducting wire or cable in coil form as illustrated in FIGS. 1–12. The Applicant has proposed a very general argument for the trapping of magnetic flux in a superconductor (cf. Nuovo Cimento article cited above) which permits a virtual violation of the Meissner effect which can be understood with reference to FIGS. 11 and 12. For any magnetic field below the value of the critical field at a given bath temperature, the superconductor must enter the intermediate state (due to magnetic field gradient) for Type I or the mixed state for Type II as the superconducting critical fields increase from zero at the transition temperature $T_c$ to their final values at the bath temperature. Slow and uniform cooling ensures nearly thermodynamic equiiibrium, resulting in an almost uniform lattice of normal regions containing flux trapped within a network of multiply-connected superconductor. Similarly, when a superconductor is held below $T_c$ in a field above the critical magnetic field, as the external field is reduced, Type II superconductors must pass through the mixed state, while Type I superconductors pass through the intermediate state. Flux trapping in specimens such as FIGS. 1 and 2 takes place in both cases because the superconductor is multiply-connected. Pinning due to defects and impurities enables the superconductor to maintain the trapped field as described in U.S. Pat. No. 4,190,817 issued to Mario Rabinowitz in 1980.

A second argument was also proposed by the Applicant in the same Nuovo Cimento article. The process of cooling a superconductor proceeds from the outside inward, and coupled with low bulk thermal conductivity, initiates the superconducting transistion at the outside of the superconductor. The superconductor is thereafter multiply-connected, which prevents flux in the internal macroscopic regions from escaping as these regions shrink to microscopic size provided there is adequate pinning.

A third explanation postulates an inhomogeneity in the form of a multi-connected system of thin elements having critical fields above that of the majority of material within the superconductor. The high critical fields of these connected filaments, known as a Mendelssohn sponge, can be caused by strains, impurity concentration gradients, or lattice imperfections. If such a specimen is placed in a magnetic field sufficient to make it entirely normal, and the field is subsequently reduced, the anomalous regions will become superconducting first, trapping flux by virtue of their connectivity. A fourth explanation can be made analogously by assuming a distribution of transition temperatures. However, as seen from the first and second arguments there is no necessity to invoke the Mendelssohn sponge.

In the present invention, the magnetic field may be trapped by two independent methods; or a combination of the two:

A. The Superconductor is at T Below the Transition Temperature $T_c$.

When the superconductor is at a temperature T below $T_c$, it is preferable to drive the superconductor normal by exceeding $H_{c2}$ at T, in order to store a large field in it. This may be done by pulsing the normal coil to a magnetic field that exceeds the second critical field, $H_{c2}$, at the operating temperature T. Alternatively an auxiliary concentric coil may be used to produce a pulsed field which adds to the field of the normal coupling coil 2.

B. The Superconductor is Initially Above the Critical Temperature

In this case the applied magnetic field may have any magnitude. The field is stored when the superconductor is cooled below $T_c$.

C. A combination of methods A and B may be used to trap the magnetic field.

The energy stored in the electromagnetic field of the superconductor may be returned as power in the electrical circuit by the following means.

D. Raise the temperature of the superconductor above $T_c$.

E. Pulse the magnetic field of the coil so that the net field exceeds $H_{c2}$ at T at the superconductor.

F. A combination of D and E may be used to release the trapped (stored) magnetic field energy.

G. The stored magnetic field energy may also be released by any of a number of other means such as ultrasonic energy input; light excitation (of high enough frequency to break up electron pairs) as with a laser pulse; localized heating with heating coils; etc.

Specific Embodiments

FIG. 1 is a cut-away drawing of an underground TES system that has common features for most electric power utility applications. Superconducting elements or granules 1, are surrounded by a normal coil 2 made of wire or cable, and immersed in a cryogen 3 which fills up and circulates through the interstices between the compacted granules. Three basic sizes of granules (as is well-known in the art) can give a high percentage of compaction. Direct current flowing through the normal coil 2 produces a magnetic field whose energy is trapped (stored) in the superconducting granules 1. No current need flow in the coil after the magnetic field is trapped. When energy is to be released from the trapped field to flow as electric power in the utility circuit, the normal coil 2 couples to the time rate of change of the decreasing trapped field to deliver this power to the external circuit.

When there is current flowing in the coil 2, there is an outward radial force and a longitudinal compressive force on the coil. Similarly when there is a trapped magnetic field, there is an outward radial force and a longitudinal compressive force on the ensemble of superconducting granules 1. The outward radial force is transmitted to the earth 4 (bedrock) by means of load-bearing struts 5. As shown in the preferred embodiment, the coil 2 is inside the cryogenic vessel (dewar) 6. This has the advantage of increasing the coil's electrical conductivity, and decreasing it's resistive losses. In this case, the struts support a thermal gradient (cold-to-warm) and are designed to minimize heat leak. Alternatively, the coil 2 may be outside the cryogenic vessel 6. In this alternative case, the struts 5 may also be outside the cryogenic vessel 6, and heat leak need not be a consideration for them.

The cryogenic vessel 6 has thermal insulation 7. This thermal insulation 7 is preferably a closed cell foam (such as styrofoam) containing a vapor such as freon. When cooled, the vapor condenses forming a vacuum in the closed cells. The foam constitutes a satisfactory thermal insulation 7, for example, in insulating between 77K (liquid nitrogen temperature) and 300K (ambient temperature). Alternatively, the thermal insulation 7 may be vacuum with heat shields. If this is the case, the vacuum system used for evacuating and maintaining the vacuum in the dewar 6 may also be used for pumping on the cryogen 3 to lower the cryogen's temperature. Decreasing or increasing the pressure over the cryogen is one way of decreasing or increasing the cryogen's temperature for the field trapping or releasing steps of the operation. The temperature of the cryogen may also be changed by the refrigeration system.

The normal coil 2 may be made of materials such as Cu (copper), Al (aluminum), or Be (beryllium). If the coil 2 is operated at 77K, ordinary Al and Cu increase their conductivities by about a factor of 10 with respect to 300K with no advantage in going to high purity. However, high purity Be can increase its conductivity by about a factor of 50 at 77K with respect to 300K. At very low temperatures, high purity Al and Cu can increase their conductivities over a thousandfold. The heat capacity and the thermal conductivity of materials increases significantly at elevated cryogenic temperature operation as the temperature increases above 4K. So 50K to 77K TES operation would provide more inherent stability than the operation of SMES as it is limited to $\leqq 4.2K$.

Whereas FIG. 1 illustrates a large TES, any size is possible. For example, small TES with small conversion bridges may be incorporated with transformers at the transformer locations. Therefore the FIGS. 3–9 are schematic in nature, allowing for a variety of sizes and shapes of the basic TES invention.

Figure 2:
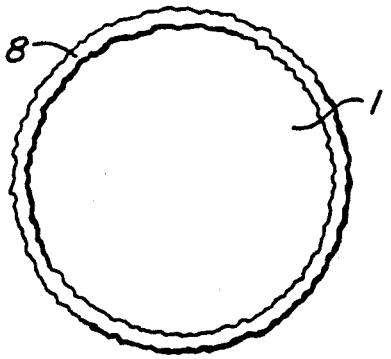
FIG. 2 is a cross-sectional view of a superconducting granule with a normal metal coating.

FIG. 2 shows the cross-section of a superconducting granule 1, coated with a normal metal 8 such as Al, Cu, or Be. The normal metal is chosen because of its high electrical and high thermal conductivity to add stability to the superconductor. The superconducting granule 1 is preferably a high temperature superconductor such as $Y_1Ba_2Cu_2O_{7-y}$ ($T_c > 94K$), $Bi_2Sr_{3-x}Ca_2Cu_2O_{8+y}$ ($T_c > 110K$), $Tl_2Ba_2CaCu_2O_8$ ($T_c > 120K$). At present, at 77K, Professor Roy Weinstein and his colleagues at the University of Houston have trapped over 13,000 Gauss in a granule of $Y_1Ba_2Cu_2O_{7-y}$, and over 20,000 G in an ensemble of several granules. One may expect even larger trapped fields at lower temperature, and as flux pinning is increased in the granules. It is expected that the higher $T_c$ superconductors will do even better than $Y_1Ba_2Cu_2O_{7-y}$ as they are developed to the same degree. The combination metal-buckeyballs (buckminster-fullerenes) which have quickly moved up to a $T_c$ of 42K, also look like promising candidates for trapped field superconductors. Examples of metallic superconductors that may be used are: $Nb_3Ge$ ($T_c=23K$), $Nb_3(Al,Ge)$ ($T_c=21K$), $Nb_3Ga$ ($T_c=20.3K$), $Nb_3Al$ ($T_c=18.9K$), and $Nb_3Sn$ ($T_c=18.1K$). A magnetic flux density of 22,400 Gauss was trapped in $Nb_3Sn$ by the Applicant and his colleagues.

To increase the trapped field of the ensemble of granules 1, it is important to keep them from moving inside the dewar 6. This may be accomplished by tightly packing (compacting) them in the dewar, or preferably forming them into a monolithic structure. The trade-off is economic. A low-melting point solder that is induction heated with the coil 2 can be used to bind them together in situ after they are in the dewar 6.

The rate of decay (decrease) of the stored magnetic field to release its energy back to the external circuit, may in part be controlled by the conductivity of the matrix of granules, metallic stabilizer, and solder; as well as by the inductance to resistance ratio of the coil and remainder of the coupled circuit. The higher the conductivity of the matrix, the lower the time rate of decay of the field. The rate of decrease may also be controlled by use of segmented coils and modular superconducting disks as described in conjunction with FIGS. 7, 8, and 9.

Figure 3:
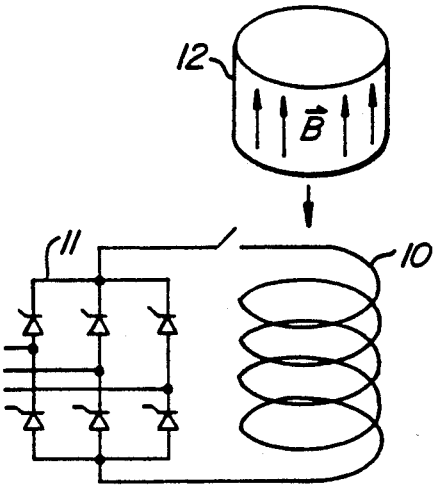
FIG. 3 is a schematic view of another embodiment showing a normal solenoid attached to a Graetz bridge ready to receive a trapped field cylinder which will release its stored magnetic energy.

FIG. 3 is a schematic diagram showing a normal coil 10 made of copper, aluminum, etc. attached to a basic six pulse Graetz bridge 11 ac/dc grid controlled reversible power converter. A three phase ac power input or load connects to the bridge at the left. This normal coil 10 is used to produce the magnetic field that will be stored (trapped) in the superconductor. A superconducting cylinder 12 with trapped field is shown about to be inserted into coil 10 for release of its energy at which time this coil 10 is used to inductively couple to the decreasing trapped magnetic field which releases its energy back to the external circuit.

The superconducting cylinder 12 may be in the form of a solid monolythic cylinder, but this is not necessary. One could have a hollow container (metallic cylinder) into which the superconductor in granular form is placed and tightly fitted. For example, the container's coefficient of expansion may be chosen to be greater than that of the superconducting granules 1 so that upon cooling, the container holds the granules tightly in place. Alternatively, the superconductor may be cemented together inside the cylinder. A good electrical and thermal conductor such as copper or aluminum may be sandwiched or interspersed around the superconductor to serve as an electro-thermal stabilizer.

Figure 4:
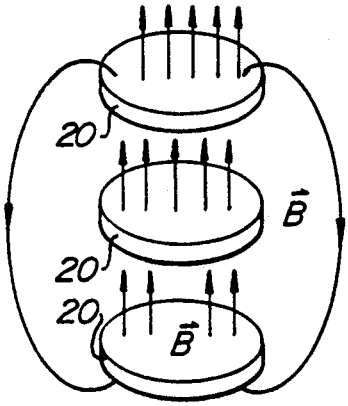
FIG. 4 shows the superconductor in disk form to be placed inside the solenoid of FIGS. 3 or 8.

FIG. 4 illustrates three disks 20 (which are foreshortened versions of the cylinder 12 of FIG. 3) with trapped field B. The trapped field B is shown perpendicular to their faces as a preferred embodiment. However, the field may also be parallel to the faces. These disks may be incorporated in any of the coil forms such as in FIGS. 3 and 8. Once the field is trapped in a disk, it may be removed from the coil and another disk inserted. Thus a small normal coil may be used to trap many more disks than its own volume. The trapped field disks are reinserted into the same coil or a separate coil when their energy is released. If it is desired to reduce the distant magnetic field of the ensemble of disks, they may be rotated to alternate their polarities while in storage.

Figure 5:
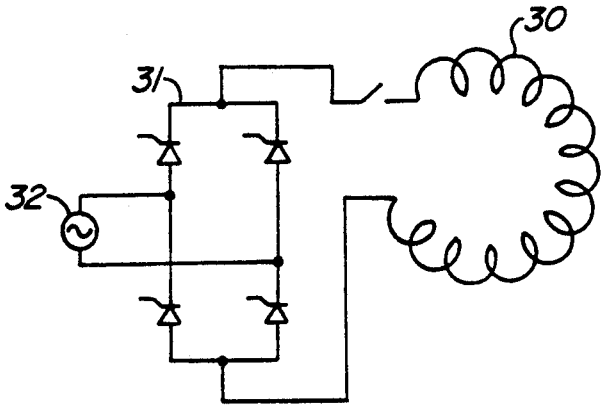
FIG. 5 is a schematic view similar to FIG. 3 but showing a normal torroidal coil attached to a four-pulse bridge.

FIG. 5 shows a normal torroidal coil 30 attached to a four pulse bridge 31 connected to a single phase circuit with ac power source 32 as an alternate configuration. The coil 10 or torroid 30 may be connected to either bridge. The torroid has the advantage that the leakage magnetic field is minimal where concern for exposure to magnetic fields needs to be taken into consideration. The disadvantage is that the magnetic forces are larger here.

Figure 6:
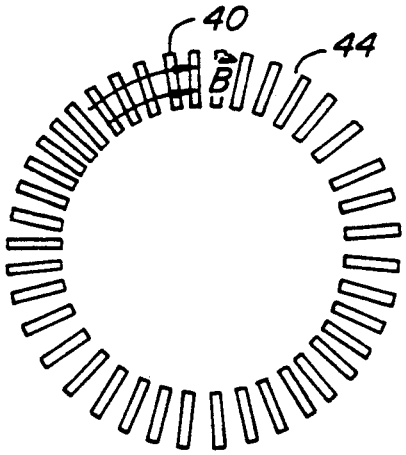
FIG. 6 is a schematic view which shows a superconductor in disk form to be placed within the torroidal coil of FIG. 5.

FIG. 6 illustrates the superconducting disks 40 with spacers 41, in torroidal configuration with trapped field B as they were present in the torroidal coil 20 of FIG. 4. This is a desirable configuration which minimizes stray magnetic fields when the trapped magnetic energy in the disks is to be transported to another location.

Figure 7:
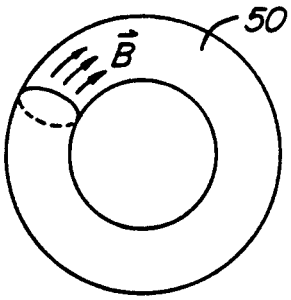
FIG. 7 is a schematic view which shows the superconductor in torroidal form to be placed within the torroidal coil of FIG. 4.

FIG. 7 shows the superconductor in torroidal form 50 (similar description to that of FIG. 6) with trapped magnetic field B that is present inside the torroidal coil 20 of FIG. 5. This torroidal configuration contains the magnetic flux within it minimizing any external field. This is a desirable configuration when the stored magnetic energy is to be transported elsewhere.

Figure 8:
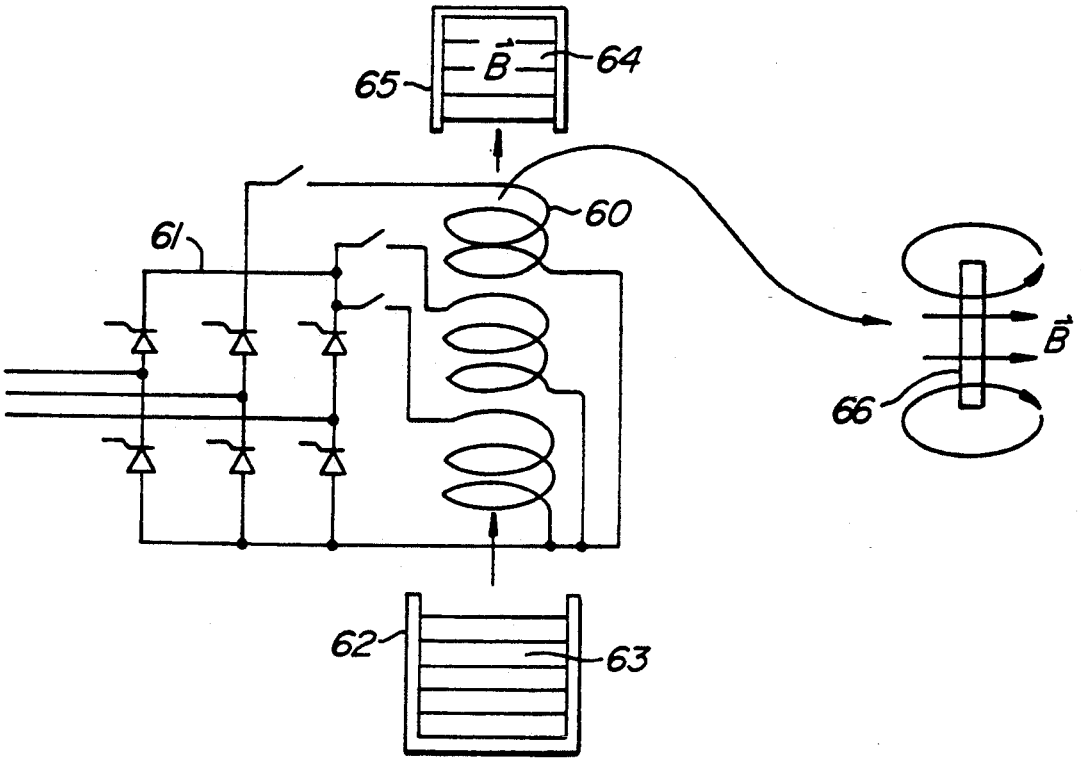
FIG. 8 is a schematic view of a *segmented* normal coil for sequential energy storage and release.

FIG. 8 is a schematic of segmented coils 60 connected to a basic six pulse Graetz bridge 61. The object of segmenting the coils 60 is so that the magnetic field may be stored or released sequentially (separately) from separate storage disks as shown in FIGS. 4 and 6. It also affords the option of storing energy in one phase, while releasing it in another to achieve power stability. The entire six pulse bridge may be connected to any one of the segments or the separate segmented coils may each be connected to a single phase of the bridge circuit which option is illustrated in FIG. 8. A storage bin 62 holds unmagnetized superconducting disks 63 for storage so they may be introduced sequentially into the coils 60. The magnetized disks 64 are then introduced into a second storage bin 65 to be held there until their energy is needed. Another option is that of transporting a magnetized disk 66 to another location.

Figure 9:
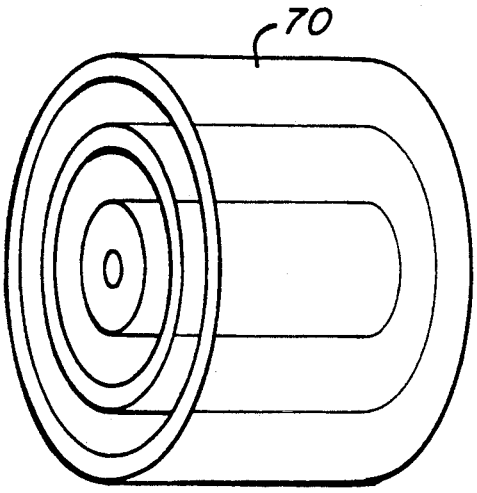
FIG. 9 is a schematic view which illustrates separate hollow superconducting concentric cylinders for TES.

FIG. 9 illustrates a body having separate hollow concentric cylinders 80 for containing the superconducting material. A magnetic field may be trapped parallel or perpendicular to the axes of these cylinders 70. When the magnetic field is trapped parallel to the cylinder axis, an azimuthal transport current circulates around the cylinder and the superconductor must be contiguous. The requirement of contiguity is not necessary when the field is trapped perpendicular to the axis of a cylinder. These cylinders may be placed in any of the coil configurations shown, or between the normal coils of a dipole magnet.

Figure 10:
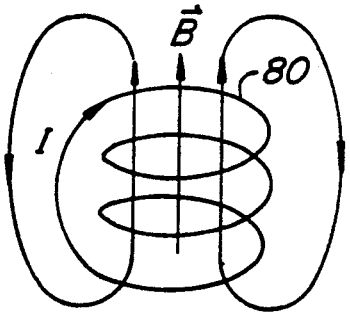
FIG. 10 is a schematic view which shows a small closed circuit superconducting coil in the persistent current mode.

FIG. 10 is a schematic view which shows a small closed circuit superconducting coil 80 having persistent supercurrent I flowing in it to store the magnetic field B. This aspect differs from SMES as a normal coil is used to induce or receive the stored energy. Thus small superconducting coils 80 may be inserted into or removed from a normal coil as in FIGS. 3, 5, and 8.

Figure 11:
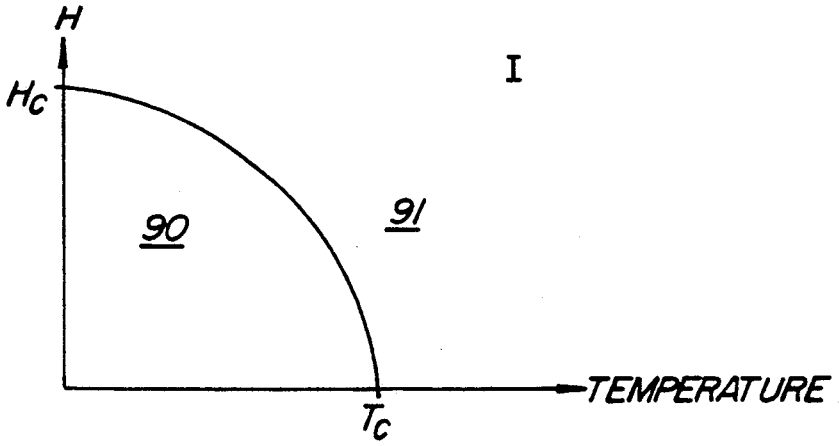
FIG. 11 shows a phase diagram for a type I superconductor.

FIG. 11 shows a phase diagram for a Type I superconductor in which the vertical axis represents the applied magnetic field H, and the horizontal axis represents the temperature. The superconducting state 90 is inside the curved line between the critical field $H_c$ and the critical temperature $T_c$. The normal region 91 is outside the curved line. Field enhancement due to the geometry of the superconductor can produce an intermediate state of combined normal and superconducting regions.

Figure 12:
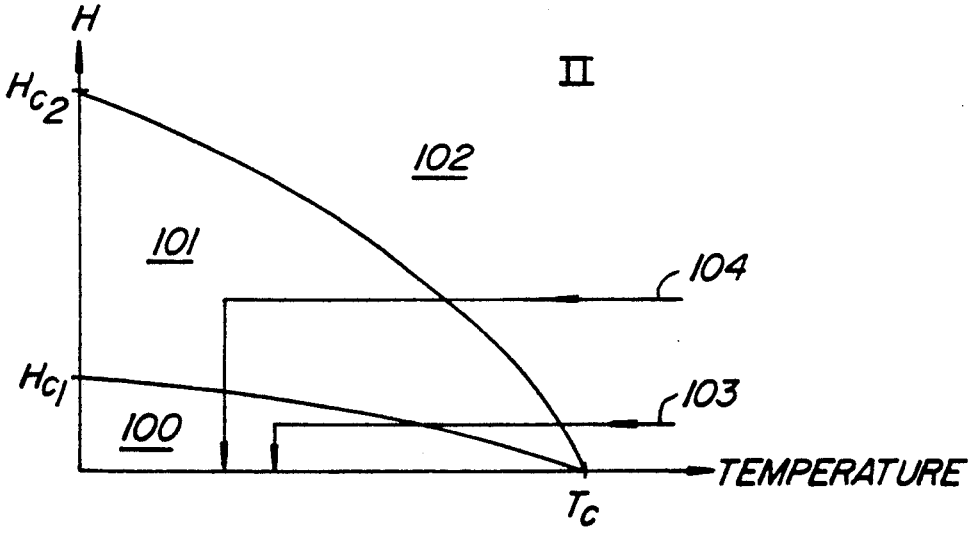
FIG. 12 shows a phase diagram for a type II superconductor.

FIG. 12 shows a phase diagram for a Type II superconductor in which the vertical axis represents the applied magnetic field H, and the horizontal axis represents the temperature. The total superconducting state 100 is inside the curved line between the first critical field $H_{c1}$ and the critical temperature $T_c$. This is followed by a mixed state 101 between the first critical field $H_{c1}$ and the second critical field $H_{c2}$. The mixed state contains a mixture of the superconducting state threaded by a matrix of normal regions containing flux, and is hence multiply-connected. The normal region 102 is outside the outermost curved line. If we cool the superconductor in an applied field $<H_{c1}$ as shown by the line 103, the state of the superconductor goes through the mixed state as shown. Finally the applied field is removed as shown. If we cool the superconductor in an applied field $>H_{c1}$ as shown by the line 104, the state of the superconductor again goes through the mixed state as shown. Finally the applied field is removed as shown. If the superconductor has adequate pinning to hold the magnetic flux to which it was exposed, a trapped magnetic field will remain.

While the invention has been described with reference to preferred and other embodiments, the descriptions are illustrative of the invention and are not to be construed as limiting the invention. Thus, various modifications and applications may occur to those skilled in the art without depending from the true spirit and scope of the invention as defined by the appended claims.

I claim:

1. Apparatus for storing trapped superconducting magnetic field energy comprising:

a coil having means for directing an electrical current therethrough; and superconducting material adjacent to the coil and coupled magnetically thereto, whereby a magnetic field generated by the coil when an electrical current is directed therethrough will be stored in the material.

2. Apparatus as set forth in claim 1, wherein said superconducting material includes a volume of granules, there being a space within the coil, said space containing a liquid cryogen, the granules being immersed in the cryogen.

3. Apparatus as set forth in claim 2 wherein the coil has a space therewithin and the cryogen circulates through the interstices between the granules, the granules being compacted in the space within the coil.

4. Apparatus as set forth in claim 1, wherein is included a cryogenic vessel, the coil being within the vessel.

5. Apparatus as set forth in claim 1, wherein is included a cryogenic vessel, the material being within the vessel, said coil being outside the vessel.

6. Apparatus as set forth in claim 1, wherein is included a cryogenic vessel, said vessel having a layer of thermal insulation thereon at the inner surface thereof.

7. Apparatus as set forth in claim 6, wherein said insulation is a closed cell foam having a vapor therein to form a vacuum when the vapor is cooled.

8. Apparatus as set forth in claim 7, wherein the vapor is Freon.

9. Apparatus as set forth in claim 1, wherein the material is in the form of granules, the granules being coated with a metal taken from the group including Al, Cu, and Be.

10. Apparatus as set forth in claim 1, wherein said current directing means includes a Graetz bridge.

11. Apparatus as set forth in claim 1, wherein said current directing means is taken from the group including flux pump, homopolar generator, and diodes.

12. Apparatus as set forth in claim 1, wherein said coil is a torroid.

13. Apparatus as set forth in claim 1, wherein the superconducting material is in the form of a solid monolithic member, said member being in the coil.

14. Apparatus as set forth in claim 13, wherein the member is hollow, said superconducting material including granules in the member.

15. Apparatus as set forth in claim 13, wherein the member is a torroid.

16. Apparatus as set forth in claim 15, wherein the torroid is hollow, said superconducting materials including granules in the torroid.

17. Apparatus as set forth in claim 13, wherein the member comprises disks.

18. Apparatus as set forth in claim 17, wherein is included a storage bin for containing the segments before the segments are magnetized, and a holding bin for retaining the magnetized segments until the segments are ready for use.

19. Apparatus as set forth in claim 17, wherein each disk is capable of being rotated relative to the other disks to reduce the external field.

20. Apparatus as set forth in claim 1, wherein the magnetized superconducting material is in the form of disks, said disks being transportable to distant locations.

21. Apparatus as set forth in claim 20, wherein said disks are in torroidal form.

22. Apparatus as set forth in claim 1, wherein is included at least one hollow cylinder, said superconducting material being within the cylinder.

23. A method for storing trapped superconducting magnetic energy comprising:

placing a mass of superconducting material adjacent to a coil and in magnetic coupled relationship thereto; and directing an electrical current through the coil to cause the coil to generate a magnetic field in the material mass, said magnetic field being storable as energy in said material mass.

24. Apparatus for enhancing power stability of an electrical power system comprising:

a coil having means for directing an electrical current therethrough; and a mass of superconducting material adjacent to the coil and in magnetic coupled relationship thereto, whereby a magnetic field generated by the coil when an electrical current is directed through the coil will remove undesired oscillations and other deleterious problems of the power system.

* * * * *